United States Patent [19]

Leib

[11] Patent Number: 4,946,224

[45] Date of Patent: Aug. 7, 1990

[54] COMBINATION WOOD-METAL CHAIR

[76] Inventor: Roger K. Leib, 1064 S. Crescent Heights, Los Angeles, Calif. 90035

[21] Appl. No.: 171,420

[22] Filed: Mar. 21, 1988

[51] Int. Cl.[5] ..... A47C 1/02

[52] U.S. Cl. ..... 297/445; 297/287; 297/294

[58] Field of Search ..... 297/445, 294, 295, 287; 248/243, 915

[56] References Cited

U.S. PATENT DOCUMENTS

| | | | |
|---|---|---|---|
| Re. 20,372 | 5/1937 | Lorenz . | |
| Re. 27,176 | 9/1971 | Froelich | 297/284 |
| D. 90,705 | 9/1933 | Goodman | D6/371 |
| D. 232,215 | 7/1974 | Lamb | D6/372 |
| D. 252,901 | 9/1979 | Petersen | 6/1 |
| D. 254,042 | 1/1980 | Hosoe | D6/372 |
| D. 262,502 | 1/1981 | Wilson | D6/56 |
| D. 272,967 | 3/1984 | Umanoff | D6/356 |
| 458,140 | 8/1881 | Bangs | 297/460 |
| 693,323 | 2/1902 | Rodgers . | |
| 1,791,453 | 2/1931 | Mies . | |
| 1,928,939 | 10/1933 | Larsen | 297/295 |
| 1,950,226 | 3/1934 | Cable . | |
| 1,979,073 | 10/1934 | Larsen . | |
| 2,064,137 | 12/1936 | Zerbee | 297/287 |
| 2,069,456 | 2/1937 | McGowen | 297/283 |
| 2,071,084 | 2/1937 | Nolan | 297/445 |
| 2,121,130 | 6/1938 | McGowen . | |
| 2,135,657 | 11/1938 | Church . | |
| 2,186,705 | 1/1940 | Lorenz . | |
| 2,530,924 | 11/1950 | Turner . | |
| 2,586,262 | 2/1952 | Robins | 297/294 |
| 2,625,205 | 1/1953 | Holmes . | |
| 2,679,893 | 6/1954 | Bennet | 297/282 |
| 2,699,200 | 1/1955 | Lingle . | |
| 2,905,230 | 9/1959 | Gabriel | 297/460 X |
| 2,913,038 | 11/1959 | McDerby | 297/295 X |
| 2,970,638 | 2/1961 | Halter . | |
| 3,092,417 | 6/1963 | Drabert | 297/391 |
| 3,101,217 | 8/1963 | Requa | 297/391 |
| 3,131,970 | 5/1964 | McGregor | 297/445 |
| 3,147,997 | 9/1964 | Mason | 297/452 |
| 3,165,356 | 1/1965 | Geier et al. | 297/216 |
| 3,259,427 | 7/1966 | Wiest | 297/D1610 |
| 3,343,871 | 9/1967 | Yates | 297/D1610 |
| 3,361,471 | 1/1968 | Radford | 297/230 |

(List continued on next page.)

FOREIGN PATENT DOCUMENTS

| | | | |
|---|---|---|---|
| 560673 | 9/1932 | Fed. Rep. of Germany . | |
| 869114 | 3/1953 | Fed. Rep. of Germany . | |
| 633980 | 10/1927 | France | 297/302 |
| 764919 | 3/1934 | France . | |
| 907057 | 6/1945 | France . | |
| 1072212 | 3/1954 | France | 297/302 |
| 529845 | 6/1965 | Italy . | |
| 74283 | 3/1930 | Sweden . | |
| 170727 | 7/1934 | Switzerland | 297/287 |
| 416758 | 9/1934 | United Kingdom . | |
| 458722 | 12/1936 | United Kingdom | 297/294 |
| 467294 | 6/1937 | United Kingdom | 297/287 |
| 515460 | 12/1939 | United Kingdom | 297/294 |

OTHER PUBLICATIONS

MIES Chair Designs, a sales brochure published by Knoll International, New York more than one year prior to the filing of the subject application.

Warren Chair Photo. Published by Add Interior Systems in a about Feb. 2, 1981.

Chair Photo by Add Interior Systems.

Thonet IDG Kangaroo Chair, *Interior*, Nov. 1976, p. 28.

Add Interior Systems, Inc., "Rose Chair", Oct. 1982.

U.S. patent application Ser. No. 937,485.

*Primary Examiner*—Laurie K. Cranmer

*Attorney, Agent, or Firm*—Jeffrey G. Sheldon

[57] ABSTRACT

A chair comprising a combination of metal and wooden members provides a pleasing aesthetic warm appearance and a durable structure with a pivotal rocking action for the seat and backrest. A cut-out portion of the front leg houses a rectangular metal post constituting a metal bracket to support the pivotal function of a frame for the seat and backrest. A plate or panel can overlay the metal post inset in the front leg to retain an overall substantially wooden appearance to the chair.

33 Claims, 1 Drawing Sheet

U.S. PATENT DOCUMENTS

| | | | |
|---|---|---|---|
| 3,379,450 | 4/1968 | Jones et al. | 297/D1610 |
| 3,379,474 | 4/1968 | Schwarz, Jr. | 297/440 |
| 3,606,464 | 9/1971 | Arbuthnot | 297/460 |
| 3,677,601 | 7/1972 | Morrison et al. | 297/456 |
| 3,716,270 | 2/1973 | Frazier | 297/377 |
| 3,762,769 | 10/1973 | Poschl | 297/284 |
| 3,815,955 | 6/1974 | Gililterra | 397/245 |
| 3,876,250 | 4/1975 | Eberle | 297/446 |
| 4,049,315 | 9/1977 | Jacobson | 297/447 |
| 4,067,606 | 9/1977 | Desmoulins et al. | 297/447 |
| 4,077,664 | 3/1978 | Harder, Jr. | 397/183 |
| 4,234,228 | 11/1980 | Flamm | 297/141 |
| 4,529,246 | 7/1985 | Leib | 297/285 |
| 4,555,139 | 11/1985 | Leib | 297/460 |
| 4,784,435 | 11/1988 | Leib | 297/445 |

COMBINATION WOOD-METAL CHAIR

BACKGROUND

This invention relates to chairs. In particular, it relates to an improved chair having pleasing aesthetic characteristics and employing a combination of metal and wood so as to impart adequate strength and the suitably warm residential appearance traditionally associated with wood, and so as to provide the decorative continuity of an otherwise wood-furnished environment.

Chairs of many designs are known. Generally, metal chairs can be extremely functional and durable by virtue of the strength characteristics imparted by metal; however, such chairs do not create the warm ambience provided by wood. Wood, on the other hand, does not necessarily provide adequate strength for chairs which have unique characteristics such as a pivoted or cantilevered seat or backrest. There are particular environments where it is desirable to combine these features, in other words, to have a chair with strong features providing for movement such as front-pivotable action of the seat, and at the same time to have the warmth and residential character traditionally associated with wood that can coordinate more suitably with other wood furniture in proximity. A particularly suitable environment for chairs having these characteristics is in nursing homes. Chairs there can provide for a restful motion as can be imparted by a slight rearwardly deflecting front pivoting action available to a seat and backrest of a chair, while at the same time the warmth of the structure given by the wood adds to the pleasantness of the environment.

One prior art chair developed by the Applicant and which is the subject of a pending application Ser. No. 836,606, filed Feb. 27, 1986, describes a metal chair which has two side members defined by inverted angular "U"-shaped elements. The contents of this application are incorporated by reference herein. The forward vertical limb of the "U" forms the front leg, the rear vertically inclined limb of the "U" forms the back leg and the top horizontal cross-member of the "U" forms the armrest. About mid-way up the front leg there is welded a support bracket so that a seat frame can pivotally be suspended from the front leg for a pivoting rocking type motion. This chair is structured of an all metal frame and a metal support member except for the actual seat and backrest which are constructed by material strung across the back and seat frames.

In another prior art chair of the Applicant, which is the subject of U.S. Ser. No. 937,485, filed Dec. 3, 1986, now U.S. Pat. No. 4,784,435 a similar construction is disclosed. The contents of this application are incorporated by reference herein. In that disclosure, the side members are angular "C"-shaped elements where the top limb of the "C" forms the armrest, the vertical cross-limb forms the front leg and the bottom limb of the "C" forms a base for the chair. In this case, the base of each member is connected at its free end at the rear of the chair and the frame constitutes a form of sled structure. Both these chairs are metal in construction except for the seat and back material extending across the frames.

A drawback to both of these chairs in some environments is that the metal structure does not necessarily provide the warm residential character traditionally associated with wood or the decorative continuity that can be required by an otherwise wood-furnished environment.

Accordingly, there is a need to provide a chair with the overall appearance of wood furniture with enhanced comfort characteristics where the chair is sufficiently strong to provide comfortable pivoting seating

SUMMARY

By my invention, I seek to fulfill the needs which are lacking in existing chairs. By the term "chair" as used in this application, I include not only a seating arrangement for a single person but an extended seating arrangement in the form of a settee or modular grouping.

According to my invention, a chair comprises spaced-apart parallel wooden side members, each side member forming a front leg and armrest for the chair. Each wooden side member can also form a bottom runner and/or a back leg. The chair also comprises a pair of spaced-apart parallel frame members defining the contours of a seat and backrest. These frame members are pivotally supported substantially about the front legs on a pair of metallic support elements. Each support element is connected with the front leg of a respective side member. So that the chair has a pleasing aesthetic appearance, cover means hide the support elements from normal view whereby the side members have an overall substantially wooden appearance.

Each support element can comprise a metal post that is substantially rectangular in transverse cross section and that extends partly along the length of the front leg and is at least partly imbedded in the front leg.

The length of each post is from about 6 inches to about 24 inches and is, preferably, betWeen about 10 inches and about 20 inches. Each support element includes a substantially "L"-shaped element welded to the rectangular post such that a flange extends substantially parallel to the post and another flange extends substantially normal to the post. A web between the two limbs imparts strength to the "L"-shaped element. The support elements act to transfer movement from the seat and back, which are mounted on the flanges, into the post and hence into the wooden side member.

Holes in each post permit the posts to be screwed into its respective front leg. The post is inset into the side of the leg and is covered by a panel or plate of wood whereby substantially solely the "L"-shaped element extends from the post.

The side members can be constructed by four components interlinked to form an approximate trapezoidal shape on each side of the seat and backrest.

A transverse bar preferably joins the side members below the seat to improve the rigidity of the chair. The transverse bar can be reinforced and can be of metal embedded in wood. It is preferably located between the rear legs of the chair. A second such transverse bar can be added under the seat front between the front legs of the chair.

The invention is now further described with reference to the accompanying drawings which illustrate the chair.

DESCRIPTION

Figure 1:
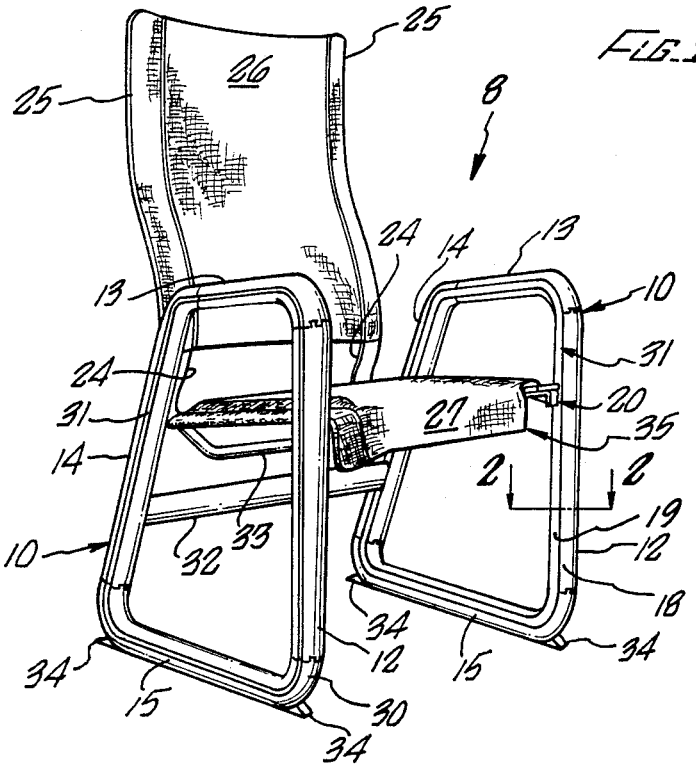
FIG. 1 is a perspective view taken partly from the front and partly broken away illustrating the spaced side members with the frame and seat and backrest between the side members.

A chair 8 includes spaced apart parallel side members 10 that are of an approximate trapezoidal shape. Each side member 10 forms a front leg 12, an armrest 13 a rear leg 14, and a bottom runner or base 15. The side members 10 are formed of wood and thereby provide a warm, aesthetic appearance to the chair. Within the front legs 12 are mounted metal support elements or bars 16 most of the way up the length of the front legs. The support bars 16 are rectangular posts having a length from about 6 inches to about 24 inches, and preferably from about 10 to about 20 inches.

A mating cutout 17 is provided on the inside face 18 of each front leg 12 to accommodate the rectangular post 16 so that the post is inset from the inside face 18. A wooden panel or plate 19 can be accommodated over the rectangular post 16 effectively to embed and conceal the rectangular post 16 in the wooden side members 10.

Each support element, bar, or post 16 is provided with an "L"-shaped flange 20 including a transverse limb 21 extending from the post 16 rearwardly towards the rear legs 14 of the chair and a vertical continuation flange or limb 22 extending substantially parallel along the length of the post 16, namely, substantially vertically down the front leg 12. A supporting web 23 extends between the two limbs 21 and 22 to transfer movement from the transverse horizontal limb 21 to the vertical limb 22 and thus to the vertical support bar 16.

A frame member 24 is provided for each side of the chair. The frame members 24 form the frame for the chair backrest 26 and seat 27. Each frame member 24 is anchored with one of the limbs 21 and extends rearwardly towards the rear legs 14 of the chair and then upwardly as indicated by numeral 25 to form the frame or contour structure for the backrest 26 of the chair. The rearwardly extending portions of the frame members 24 provide the support for the seat 27 of the chair. The backrest 26 and seat 27 are constituted by material suspended between the two frame members 24.

Mounting apertures 36 are spaced apart in the horizontal limb 21 to enable one area of the frame members 24 to be secured to each horizontal limb 21. In this manner, the frame members 24 are pivotally secured with the metallic support bar 16 through the L-shaped transverse element 21 so that pivoting and deflection action of the seat 27 and backrest 26 can take place in substantial unison when a person sits in the chair or lifts themselves from the chair. The chair in this manner provides for comfortable seating.

Figure 2:
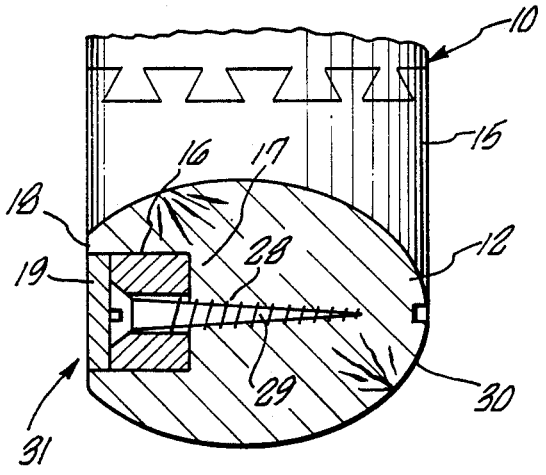
FIG. 2 is a partial sectional view through a front leg of the chair of FIG. 1 taken on line 2—2 in FIG. 1 and illustrating the cross-section of the front leg and the interrelationship of a metal support bracket within a wooden front leg.
Figure 3:
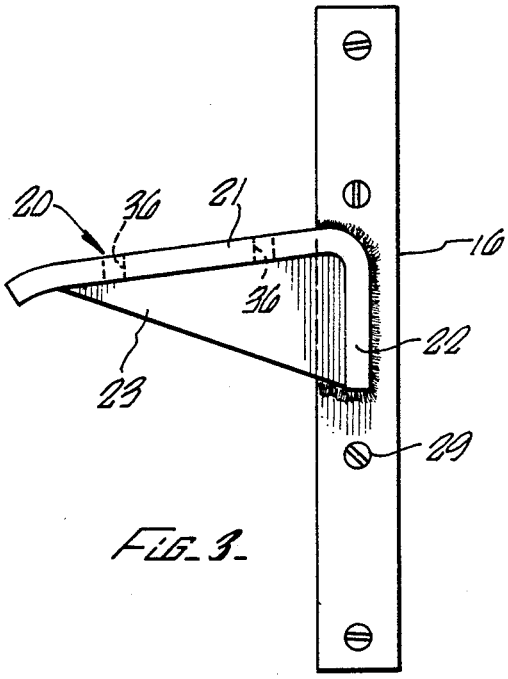
FIG. 3 is a side view of the metal support bracket of FIG. 2 illustrating the rectangular post with the "L"—shaped limb.

The metal support bar 16 include spaced apertures 28 along the length of the support bar 16 so that anchoring screws 29 can be passed through the bar 16 into the inside portion of the front legs 12 and thereby secure the metal bar 16 within the inside front leg portion 12. As illustrated in FIG. 2, the screws 29 extend transversely from the inside of the chair front leg 12 towards the outside face 30 of the chair front leg 12. The decorative matching wood coverstrip 19 is shown on the inside-facing surface 18 parallel with the inside-facing surface 18. The inside face 18 of each front leg 12 is flattened to harmoniously blend with the flattened face of the cover strip 19. To the extent that it is necessary to blend the flattened faces 18 and 19 with the remaining portions of the side members 10, this can be effected, for instance, with curved portions, to provide a suitably desirable aesthetic appearance. As shown in FIG. 2, only the inside face 18 of the legs 12 is flat, the remaining portions being curved. In the embodiment illustrated this creates a generally oval-like cross-section for the front legs.

As discussed above, each side member 10 in its trapezoidal shape provides the substantially vertical front leg 12, the substantially horizontal rearwardly sloping armrest 13, and the rearwardly sloping back leg 14 extending backwards towards the floor from the armrest 13. Each side member 10 also provides a horizontal base sled 15 for increased integrity strength and rigidity to the side members by unifying their resistance to rocking within their own plane. Extending between the two side members 10 is a cross-brace or stretcher bar 32 which can be made of wood longitudinally and internally reinforced with steel. The stretcher bar 32 extends below the seat 27 to provide enhanced rigidity and lateral load resistance to the frame support by providing a strong construction between the vertical legs and horizontal cross-bar. Additionally, cross-frames 33 can be provided to maintain the spacing between the frames of the backrest 26 and/or seat 27. Only the cross-frame 33 adjacent the backrest 26 is visible in FIG. 1.

As necessary, feet 34 are provided under the curved ends of the bases 15 in order to broaden the stance of the base against tipping.

The side members 10 can be made of concentric laminations of wood or of solid wood. When solid, each of the side members is constructed by four components interjoined together to form the trapezoidal shapes. The ends of the four component wood pieces can be cut into finger joints, for instance, that intermesh with adjacent finger joints on the adjacent limbs thereby forming the side members. In this manner, the side members also provide adequate integrity, strength, and rigidity to the leg support structure, since a lack of rigidity of wood joints could tend to loosen them over time. The trapezoidal structure depicts a continuous loop and the bases 15 can act as skids. A laminated version of the same side member can provide the structural function for the chair but with greater strength and material economy.

The chair 8 provides a pleasing, aesthetic structure that is warm in appearance and yet sufficiently strong to accommodate the cantilevered or pivoting rocking action about the front legs. As the seat 27 and backrest 26 are pivotally suspended from the front legs only, a desirable rocking motion is imparted to the chair.

Although the present invention has been described in considerable detail with reference to certain preferred versions, many forms of the invention exist each differing from the other in matters of detail only. For example, in some versions, instead of a fabric extending between the frame members 24 to form the seat and back rest, a more rigid kind of construction can be provided. In the illustrated embodiment, the seat 27 has an overlaid lip 35 extending in front of the seat 27 to hide aspects of the support structure and to provide an under-the-thighs seat front that does not cut off circulation in the user's legs. In other forms, this can be unnecessary. Likewise, in other constructions, the post 16 can extend over a greater portion of the front leg and partly into the base sections 15 and also into the armrest 13 and even into the rear legs 14. Also, rather than the post 16 being covered by the plate 19, the post 16 can be painted with a paint having a wood-like appearance.

In yet different constructions, the seat 27 and backrest 26 can be extended laterally to form a wider structure or additional seats and backs can be added modularly to the side can share a common intermediate leg that supports the seat and back to each side. Yet further, a portion of the rear leg or the base sections can be eliminated through extension of the inset bar-structure 16 around the leg bends or through the use of an adequately rigid cross-section of concentric wood laminations to form side leg structures. In yet a different alternative embodiment, the bottom section 15 of the wood leg structure can be moved upwardly to form a brace between the front and rear leg sections so that the chair is a four-legged structure. In other cases there are stretchers between the respective front legs and rear legs.

In view of these different versions, the spirit and scope of the appended claims should not be limited to the description of the preferred versions contained herein.

What is claimed is:

1. A chair comprising:

(a) a pair of spaced-apart, wooden side members, each side member forming a front leg and an armrest;

(b) a pair of spaced-apart, frame members forming a seat and a backrest;

(c) a pair of metallic support elements pivotally supporting the frame members to pivot substantially about the front legs, each support element being connected with the front leg of a respective member, each support element comprising a substantially rigid metal post extending at least partly along the length of the corresponding front leg and being at least partly embedded therein, the metal post being substantially rectangular in cross section; and (d) cover means substantially hiding the metal posts from normal view so that the side members have an overall substantially wooden appearance.

2. The claim of claim 1 wherein each side member also forms a rear leg, the rear legs being substantially parallel to each other and spaced apart from each other.

3. A chair as claimed in claim 2 including a transverse cross-bar for joining the rear legs.

4. The chair of claim 3 in which the transverse cross-bar is made of combined metal and wood.

5. A chair as claimed in claim 3 wherein the transverse cross-bar is positioned below the seat level.

6. A chair as claimed in claim 2 wherein the front legs are substantially vertical and the rear legs slope rearwardly and downwardly from the armrest.

7. A chair as claimed in claim 2 including a stretcher bar connecting the rear legs.

8. A chair as claimed in claim 1 or 2 wherein each wooden side member also forms a bottom sled.

9. A chair as claimed in claim 1 wherein each metal post is at least 6 inches in length.

10. A chair as claimed in claim 9 wherein the post length is from about 6 inches to 24 inches.

11. A chair as claimed in claim 10 wherein the post length is from about 10 inches to 20 inches.

12. A chair as claimed in claim 1 wherein each post has spaced apertures for receiving anchoring means for anchoring the post within its respective front leg.

13. A chair as claimed in claim 1 wherein each wooden frame member includes four separate components, each component being interlinked together to form a trapezoidal shape.

14. A chair as claimed in claim 13 wherein the four components are formed of wood, each end of each component being joined to adjacent components by finger joints and interlocked with finger joints of the adjacent components.

15. A chair as claimed in claim 1 wherein the seat and backrest include material extending across the frame members, the material hiding the frame members from view.

16. A chair as claimed in claim 1 wherein the wooden side members are formed of laminated layers of wood.

17. The claim of claim 1 wherein the cover means comprises paint having a wood-like appearance.

18. The chair as claimed in claim 1 wherein each support element includes a transverse element welded to the post, the transverse element having a first limb extending substantially at right angles rearwardly from the post.

19. The chair of claim 1 wherein the side members are parallel to each other and the frame members are parallel to each other.

20. A chair comprising:

(a) a pair of spaced-apart, parallel wooden side members, each side member forming a front leg and an armrest;

(b) a pair of spaced-apart, parallel frame members forming a seat and a backrest;

(c) a pair of metallic support elements pivotally supporting the frame members to pivot substantially about the front legs, each support element being connected with the front leg of a corresponding side member, wherein each support element comprises (i) a substantially rigid metal post extending at least partly along the length of the corresponding front leg and being at least partly embedded therein, and (ii) a transverse element welded to the post, the transverse element having a first element limb extending substantially at right angles rearwardly from the post; and (d) cover means substantially hiding the rigid metal posts from normal view so that the side members have an overall substantially wooden appearance.

21. The chair of claim 20 wherein each transverse element is "L"-shaped and has a second limb extending downwardly and parallel with the post.

22. A chair as claimed in claim 21, including a web member between the two limbs for reinforcing the transverse element.

23. The chair of claim 20 wherein the metal post is substantially rectangular in transverse cross-section.

24. A chair as claimed in claim 1 or 20 wherein each wooden front leg includes a mating cutout for receiving its respective post.

25. A chair as claimed in claim 24 wherein the cutout extends deeper than the cross-section of the post such that the post fits within the cutout.

26. A chair as claimed in claim 25 wherein the cover means comprises a decorative plate for mounting over the post, the plate being of wood for encasing the post substantially within wood.

27. A chair comprising:

(a) spaced-apart, wooden side members, each side member forming (i) a front leg, (ii) a rear leg, and (iii) an armrest;

(b) a metal frame for a seat and a backrest;

(c) a pair of metal support elements for the frame, the frame being pivotally supported on and rearwardly cantilevered from the support elements substantially about the front legs such that the seat and the backrest mounted on the frame can move in substantial unison, each support element comprising a substantially rigid post embedded at least partly in a cutout portion f the front leg of a respective side member, the post having spaced apertures receiving anchoring means for anchoring the post within its respective front leg, each post extending at least partly along the length of the corresponding front leg and being covered at least partly by a member having a wooden appearance so that the side members have an overall substantially appearance.

28. A chair as claimed in claim 27 wherein the seat and backrest include material extending across the metal frame.

29. The chair of claim 27 wherein the side members are parallel to each other.

30. A chair comprising:

(a) spaced-apart, parallel wooden side members, each side member forming a front leg and an armrest;

(b) a metal frame for a seat and a backrest; and (c) a pair of metal support elements for the frame, whereby the metal frame is pivotally supported on the support elements substantially about the front legs, each support element comprising a substantially rectangular cross-sectional post embedded at least partly in a cutout portion of the front leg of a respective side member, the post being covered at least partly by a wooden decorative plate so that the side members have an overall substantially wooden appearance, and wherein each support element also includes a substantially "L"-shaped element welded to the post, the "L"-shaped element having a first limb extending substantially at right angles from the post and a second limb extending parallel to the post.

31. The chair of claim 27 or 30 wherein the post is at least 6 inches in length.

32. A chair comprising:

(a) a pair of spaced-apart, wooden side members, each side member forming a front leg and an armrest;

(b) a pair of spaced-apart, frame members forming a seat and a backrest;

(c) a pair of metallic support elements pivotally supporting the frame members to pivot substantially about the front legs, each support element being connected with the front leg of a respective member each support element comprising a substantially rigid metal post extending at least partly along the length of the corresponding front leg and being at least partly embedded therein, wherein each post has spaced apertures for receiving anchoring means for anchoring a post within its respective front leg; and (d) cover means substantially hiding the metal posts from normal view so that the side members have an overall substantially wooden appearance.

33. A chair comprising:

(a) a pair of spaced-apart, wooden side members, each side member forming a wooden front leg and a wooden armrest;

(b) a pair of spaced-apart, frame members forming a seat and a backrest; and (c) a pair of metallic support elements pivotally supporting the frame members to pivot substantially about the front legs, each support element being connected with the front leg of a respective member, each support element comprising:

(i) a substantially rigid metal post extending at least partly along the length of the corresponding front leg and being at least partly embedded therein, wherein each post has spaced apertures for receiving anchoring means for anchoring the post within its respective front leg, and each post is substantially rectangular in cross-section; and (ii) a transverse element welded to the post, the transverse element having a first limb extending substantially at right angles rearwardly from the post.

* * * * *